United States Patent [19]

Wentzell

[11] 4,255,844

[45] Mar. 17, 1981

[54] METHOD OF PREPARING POP BUMPERS OF A PIN BALL GAME FOR FIELD REPLACEMENT OF BALL WEARABLE PARTS

[76] Inventor: Edward S. Wentzell, Rte. 6, Box 111, Biloxi, Miss. 39632

[21] Appl. No.: 22,751

[22] Filed: Mar. 22, 1979

[51] Int. Cl.[3] ..... B23P 7/00; A63D 3/00

[52] U.S. Cl. ..... 29/401.1; 273/118 D; 29/402.08

[58] Field of Search ..... 29/401.1; 273/118 A, 273/118 R, 118 D, 119 A

[56] References Cited

U.S. PATENT DOCUMENTS

| | | | |
|---|---|---|---|
| 2,163,122 | 6/1939 | Hooker | 273/118 A |
| 2,302,184 | 11/1942 | Caestecker | 273/118 A |
| 2,311,447 | 2/1943 | Koci | 273/118 A X |
| 3,180,646 | 4/1965 | Zale et al. | 273/118 A |

*Primary Examiner*—Milton S. Mehr
*Assistant Examiner*—V. K. Rising
*Attorney, Agent, or Firm*—James B. Lake, Jr.

[57] ABSTRACT

Including in an upper combination electrical circuit, hold-down bolts securing an upper combination of a pop bumper to a playing table for additionally engaging and disengaging the upper combination electrical circuit, so that by merely turning the hold-down bolts both the upper combination and its electrical circuit is connectable and disconnectable to and from the playing table and the lower combination electrical circuit for easy replacement of ball wearable parts.

2 Claims, 5 Drawing Figures

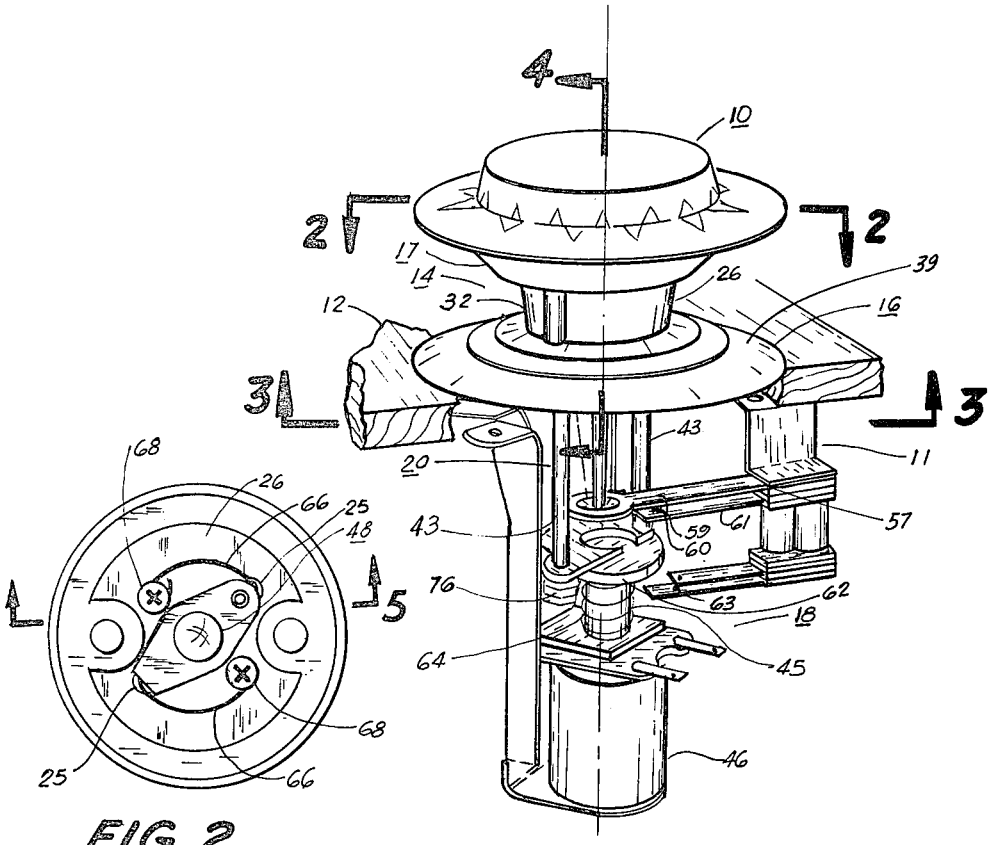
FIG. 1
FIG. 2
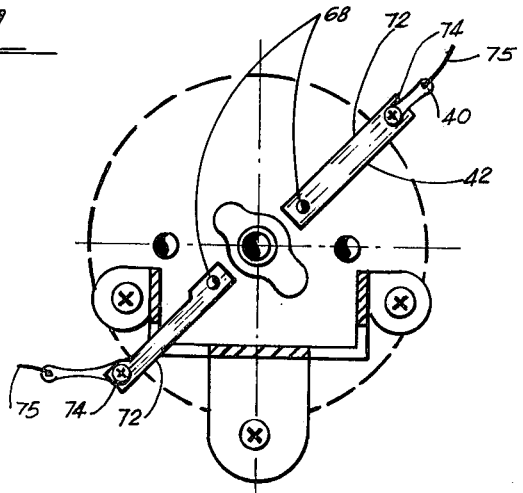
FIG. 3
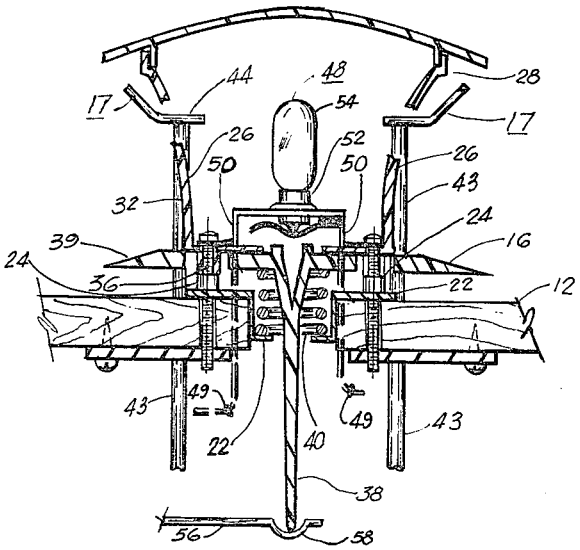
FIG. 4
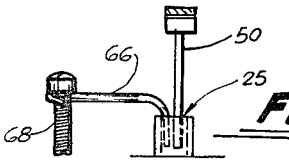
FIG. 5

METHOD OF PREPARING POP BUMPERS OF A PIN BALL GAME FOR FIELD REPLACEMENT OF BALL WEARABLE PARTS

BACKGROUND OF THE INVENTION

The invention relates to servicing pin ball games in the field, and more particularly to the field replacement of ball wearable parts in an upper combination of the pop bumper.

Heretofore electrical wire conductors connected the electrical circuit of the upper combination to those of the lower combination of a pop bumper by passing through the annular openings in the ball wearable parts of the upper combination and being soldered to wire conductors of the lower combination therebelow. The making and breaking of these soldered connections was difficult and time consuming so as to delay the replacement of wearable parts until customers refused to play the game and then it was taken back to the shop for the necessary replacement.

No search was made because the inventor was worked on all types of pin ball games from their inception.

SUMMARY OF THE INVENTION

It is an object of the invention to provide a method of preparing pop bumpers of pin ball games for field replacement of wearable parts.

BRIEF DESCRIPTION OF THE DRAWINGS

FIG. 1 is a three dimensional view of a pop bumper showing the upper and lower combinations and the game table intermediate thereof;

FIG. 2 is a cross-sectional view taken along section lines 2—2 of FIG. 1;

FIG. 3 is a cross-sectional view taken along section lines 3—3 of FIG. 1;

FIG. 4 is a cross-sectional view taken along section lines 4—4, and

FIG. 5 is a cross-section taken along section lines 5—5 of FIG. 2.

DESCRIPTION OF THE PREFERRED EMBODIMENTS

Referring to FIGS. 1-5, the invention resides in a pop bumper 10 of a pin ball game (not shown) having a pin ball 11 mounted on a playing table 12, and comprises rerouting an electrical circuit in the upper or above table combination 14 of said pop bumper to bolt connect with a lower electrical circuit for easy field replacement of ball wearable parts, that is, an annular skirt 16, and post and ring assembly 17.

A pop bumper 10 comprises, in addition to said upper or above table combination 14, the lower or below table combination 18, and through table parts extending therebetween. Referring to FIGS. 4 and 5, upper combination 14 comprises an annular base 22, supporting on legs 24 an annular body 26 having outwardly flaring upper end 28 and lower end 30 (see FIG. 4) that define therebetween a peripheral track 32; said annular skirt 16 defining holes 36 for the loose passage therethrough of legs 24, for horizontally mounting said skirt between said body and base, and having a depending projection 38 extending through said annular base 22 and table 12, skirt 16 having an outer peripheral portion 39 shaped as a shallow truncated circular pyramid; a compression spring 40 mounted around said projection 38 and between base 22 and skirt 16 for biasing said skirt upward; said post and ring assembly 17 having a ring 44 mounted below and around upper end 28 of body 26 and conforming with the flare thereof, and diametrically opposed posts 43 depending from said ring and through said skirt and table to bolt to a plunger 45 of a solenoid 46 of lower combination 18; and finally a bayonet socket and lamp assembly 48 having legs 50 insulated from each other and slip fitting into holes 25 defined in two diametrically opposed legs 24 to mount a socket 52 and lamp 54 in annular body 26. Referring to FIGS. 1 and 3, lower combination 14 includes a leaf spring 56 that is supported by an end 57, the other end defining a depression 58 for engaging depending projection 38 of skirt 16, and intermediate said ends a contact 59 fixed to the under side thereof that is normally open relative to an opposing contact 60 on a similarly supported leaf spring 61, said contacts being closed by said center projection 38 when said skirt 16 is depressed by a pin ball running up on it to close contacts 59 and 60 and energize solenoid 46 to actuate plunger 45 thereby retracting ring 44 toward skirt 16 to pinch a pin ball 11 therebetween and expell it outwardly. As the plunger 45 reaches the end of its downward movement, a lip 62 thereon opens a second pair of contacts 63 to deenergize solenoid 46; and a coil spring 64 mounted around said plunger 45 biases it upward to return ring 44 by means of posts 43 to its original position.

Referring again to FIGS. 2 and 4, the electrical circuit of the upper combination 14 comprises removing soldered connections 49 shown in phantom on FIGS. 4 and 5 between upper and lower circuits at the original ends of legs 50 (before being cut off) of the bayonet socket and lamp assembly 48. Legs 50 that originally extended below the playing table 12 are shortened to extend into holes 25 defined in legs 24. Referring to FIG. 5, short connecting wires 66 extend between hold-down bolts 68 and holes 25 which are defined in diametrically opposed legs 24, one set of wire ends being slip jam connected in holes 25 with shortened bayonet legs 50, and the other set of wire ends being respectively twisted under heads of bolts 68 which respectively engage bar terminals 72 bolted in position under table 12 by screws 74 at opposite ends of said terminals from hold-down bolts 68 (see FIG. 3). Connecting wires 66 are preferably gauge 16 to jam fit in holes 25 with legs 50 in present pop bumper bodies. Screws 74 connect the terminal ends of lower combination circuit leads 75 to bar terminals 72. Electrically from the lower circuit enters the upper circuit through hold-down bolts 68, passes through connecting wires 66 to shortened legs 50, respectively insulated from each other, to lamp socket 52 terminals and lamp 54.

Referring again to FIGS. 2 and 4, to replace ball wearable parts, hold down bolts 68 are backed off to break connection between upper and lower circuits. Post and ring assembly 17 are disconnected from plunger 45 by backing off nuts 76 from the lower ends of posts 43 (see FIG. 1). Upper combination 14 is lifted from table 12 and skirt with ring and post assembly 17 can be slipped off the inflared lower end 30 of body 26 after base 22, separating legs 24 of base and body has been removed from the body. Upper combination 14 can be reassembled by reversing this procedure with ball wearable parts, that is skirt 16 and post and ring assembly 17 replaced.

Heretofore soldered connections between upper and lower circuits were broken and resoldered from below the table and between congested parts for changing ball wearable parts, and this was difficult in the field, solder falling into congested parts and on the repairers. Often more damage was done than repaired a such great expenditure of time that the expense of removing the game to the shop, entailing the loss of revenue and the expense of trucking was all to often preferable to repairing the game on location. The simple rerouting of electrical paths with the abolition of soldered connections between the upper and lower circuits provided the unexpected and unobvious solution to the difficulty.

What is claimed is:

1. Method of preparing a pin ball game pop bumper for field replacement of ball wearable parts, said pop bumper having upper and lower combinations, the upper combination being fixed with holddown bolts through a playing table, and said combinations having respectively upper and lower electrical circuits that require breaking before replacement of said ball wearable parts, said method comprising the steps of:

(a) removing soldered connections between upper and lower electrical circuits;

(b) bolt connecting terminals of lower electrical circuit to upper combination hold down bolts at their respective lower ends;

(c) screw and jam connecting with respective conductors the respective upper ends of said hold down bolts to the remainder of said upper electrical circuit; whereby backing off said hold down bolts disconnects said upper and lower circuits and releases said upper combination from said table for replacing ball wearable parts.

2. Method of preparing a pin ball game pop bumper as described in claim 1 wherein utilizing upper electric circuit for energization by said lower electrical circuit without danger of short circuit comprises the steps of:

(a) cutting above said playing table portions of said upper electrical circuit extending to said playing table.

* * * * *